US007195495B2

(12) United States Patent
Takano et al.

(10) Patent No.: US 7,195,495 B2
(45) Date of Patent: Mar. 27, 2007

(54) CONNECTOR, AND PORTABLE TERMINAL EQUIPMENT INCLUDING THE CONNECTOR

(75) Inventors: Hirohisa Takano, Kanagawa (JP); Yuusuke Shiroyama, Kanagawa (JP)

(73) Assignee: Kyocera Elco Corporation, Kanagawa (JP)

( * ) Notice: Subject to any disclaimer, the term of this patent is extended or adjusted under 35 U.S.C. 154(b) by 0 days.

(21) Appl. No.: 11/205,649

(22) Filed: Aug. 17, 2005

(65) Prior Publication Data

US 2006/0040525 A1 Feb. 23, 2006

(30) Foreign Application Priority Data

Aug. 19, 2004 (JP) ..... 2004-240018

(51) Int. Cl.
*H01R 12/00* (2006.01)

(52) U.S. Cl. ..... 439/74; 439/660; 439/83

(58) Field of Classification Search ..... 439/74, 439/660, 295, 284, 83, 66, 247, 65, 876, 439/95, 931, 342, 884, 70–71, 563, 733.1
See application file for complete search history.

(56) References Cited

U.S. PATENT DOCUMENTS 3,975,076 A 8/1976 Shida et al.
5,599,192 A 2/1997 Olson
5,842,875 A * 12/1998 Yagi ..... 439/74
5,975,916 A * 11/1999 Okura ..... 439/74
6,019,613 A 2/2000 Kataoka et al.
6,482,023 B1 * 11/2002 Tan ..... 439/342
6,905,345 B2 * 6/2005 Zhang ..... 439/74
6,926,539 B2 * 8/2005 Zaderej et al. ..... 439/74

FOREIGN PATENT DOCUMENTS

| | | |
|---|---|---|
| JP | 08-250240 | 9/1996 |
| JP | 11-250966 | 9/1999 |
| JP | 2002198115 | 7/2002 |
| JP | 2004095241 | 3/2004 |
| JP | 2004111081 | 4/2004 |
| JP | 2004-192892 | 7/2004 |

* cited by examiner

*Primary Examiner*—Truc T. Nguyen
*Assistant Examiner*—Edwin A. Leon
(74) *Attorney, Agent, or Firm*—McCormick, Paulding & Huber LLP

(57) ABSTRACT

A connector includes a plug including a plug body made of an insulating material and at least one plug contact supported by the plug body; a receptacle including a receptacle body made of an insulating material and at least one receptacle contact supported by the receptacle body; a contact projecting portion formed on one of the plug contact and the receptacle contact; a contacting portion formed on the other of the plug contact and the receptacle contact; and a first projecting portion and at least one second projecting portion which is formed on the contacting portion, the second projecting portion being formed integral with the first projecting portion to be elongated in an insertion/extraction direction of the plug. A portion of the contact projecting portion is formed as a flat surface having a width greater than a width of the second projecting portion.

11 Claims, 2 Drawing Sheets

CONNECTOR, AND PORTABLE TERMINAL EQUIPMENT INCLUDING THE CONNECTOR

CROSS REFERENCE TO RELATED APPLICATION

The present invention is related to and claims priority of the following co-pending application, namely, Japanese Patent Application No. 2004-240018 filed on Aug. 19, 2004.

BACKGROUND OF THE INVENTION

1. Field of the Invention

The present invention relates to a connector including a receptacle and a plug which are engaged with each other to be electrically connected to each other.

2. Description of the Prior Art

A conventional connector including a receptacle and a plug which are engaged with each other to be electrically connected to each other by inserting the plug into an insertion groove formed on the receptacle has a structural problem such that foreign matter easily accumulates between contacts of the receptacle and associated contacts of the plug, i.e., between two opposed arrays of contacts of the receptacle (receptacle contacts), which are arranged on opposed inner walls in the insertion groove of the receptacle, and associated two arrays of contacts of the plug (plug contacts), which are arranged on opposite sides of the plug to be capable of being in contact with the two opposed arrays of receptacle contacts, respectively, thus causing a bad connection between the receptacle and the plug. In such a connector, foreign matter is usually removed by repeatedly plugging and unplugging the plug into and from the receptacle. However, since each receptacle contact and the associated plug contact are in surface contact with each other when the plug is connected to the receptacle, it is difficult to make each receptacle contact and the associated plug contact impose loads on each other in a concentrated manner, and accordingly, such foreign matter cannot be removed efficiently by repeatedly plugging and unplugging the plug into and from the receptacle.

To overcome such a problem, an improved connector has been proposed in which each receptacle contact (socket contact) or each plug contact (header contact) is provided with a resilient contact projecting portion which projects in a direction intersecting an insertion/extraction direction of the plug relative to the insertion groove of the receptacle. The other corresponding plug contact or receptacle contact is provided with a contacting portion which is elongated in the insertion/extraction direction and with which the contact projecting portion is in sliding contact when the plug is plugged and unplugged into and from the insertion groove, and the contacting portion thereof is provided, on a surface with which the contact projecting portion comes in contact, with a recessed portion. This improved connector is disclosed in Japanese Unexamined Patent Publication No. 2004-111081.

In such a connector, when the contact projecting portion of each receptacle contact or each plug contact is engaged in the recessed portion of the other corresponding plug contact or receptacle contact, the contact projecting portion and the recessed portion come in contact with each other at two points, which achieves a higher efficiency of removing foreign matter from the insertion groove than that in the above described conventional case where each receptacle contact and the associated plug contact are in surface contact with each other. However, if the plug and the receptacle are not precisely positioned relative to each other when the plug is plugged into the receptacle, there is a possibility of the contact projecting portion and the recessed portion being in contact with each other at only one point, or there is a possibility of the contact projecting portion not being engaged in the recessed portion. If the contact projecting portion and the recessed portion are in contact with each other at only one point, a sliding contact between the contact projecting portion and the recessed portion occurs only at a single point (on a single line), which tends to be incapable of removing foreign matter thoroughly, so that there is a possibility of the contact resistance between the plug and the receptacle becoming unstable. Moreover, if the contact projecting portion does not slip into the recessed portion but rather slides on a flat surface portion on the contacting portion on which the recessed portion is not formed, foreign matter is not trapped into the recessed portion and merely moves on the flat surface portion by insertion/extraction movements of the plug relative to the insertion groove of the receptacle, and accordingly, such foreign matter cannot be removed to a sufficient degree. Furthermore, miniaturization of such a conventional connector reduces the contact pressure between each contacting portion and the associated contact projecting portion, thus causing instability of the contact resistance between the plug and the receptacle.

If the contact projecting portion is replaced with a flat shaped or a substantially flat shaped contact portion so that each contact portion becomes capable of coming in surface contact with the associated contacting portion, it becomes difficult to make each receptacle contact and the associated plug contact impose loads on each other in a concentrated manner when the plug and the receptacle come in contact with each other, and therefore the efficiency of removing foreign matter decreases.

Foreign matter tends to accumulate in the recessed portion on each contacting portion by repeatedly plugging and unplugging the plug into and from the receptacle. Such accumulated foreign matter makes it difficult for the contact projecting portion to enter the associated recessed portion, and also makes it difficult for newly-removed foreign matter to be trapped into the recessed portion; additionally, the contact resistance between the plug and the receptacle becomes unstable because foreign matter trapped and accumulated in the recessed portion is not removed therefrom. On the other hand, if foreign matter is adhered to the recessed portion before the plug is plugged into the receptacle, such foreign matter tends to get trapped deeply into the recessed portion due to plugging and unplugging the plug into and from the receptacle, which also causes instability of the contact resistance between the plug and the receptacle.

SUMMARY OF THE INVENTION

The present invention provides a connector which is configured to be capable of removing foreign matter from between the plug and the receptacle securely and easily to establish stability of the contact resistance between the plug and the receptacle. According to an aspect of the present invention, a connector is provided, including a plug including a plug body made of an insulating material and at least one plug contact supported by the plug body; a receptacle including a receptacle body made of an insulating material and at least one receptacle contact supported by the receptacle body, wherein the receptacle contact contacts the plug contact so as to be electrically connected with the plug contact when the plug is plugged into an insertion groove of the receptacle; a contact projecting portion formed on one of the plug contact and the receptacle contact to resiliently project in a direction to come in contact with the other of the plug contact and the receptacle contact when the plug is plugged into the insertion groove of the receptacle; a contacting portion formed on the other of the plug contact and the receptacle contact to come in sliding contact with the contact projecting portion when the plug is plugged into the insertion groove of the receptacle; and a first projecting portion and at least one second projecting portion which is formed on the contacting portion to project in a direction to come in contact with the contact projecting portion, the second projecting portion being formed integral with the first projecting portion to be elongated in an insertion/extraction direction of the plug relative to the insertion groove of the receptacle. A portion of the contact projecting portion which is in sliding contact with the contacting portion when the plug is plugged into the insertion groove of the receptacle is formed as a flat surface having a width greater than a width of the second projecting portion.

It is desirable for the second projecting portion to include two second projecting portions which are arranged side by side in a direction that intersects the insertion/extraction direction of the plug.

It is desirable for the two second projecting portions to be parallel to each other and extend along the insertion/extraction direction of the plug.

It is desirable for the second projecting portion to be formed on the contacting portion to be inclined with respect to the contacting portion to increase a distance between the second projecting portion and the contact projecting portion in a direction from one end of the second projecting portion which is formed integral with the first projecting portion to the other end of the second projecting portion when the plug is plugged into and unplugged from the receptacle.

One and the other of the plug contact and the receptacle contact can be mounted to a display device unit and a circuit board, respectively, the display device unit and the circuit board being electrically connected to each other by making an insertion of the plug into the insertion groove of the receptacle.

One and the other of the plug contact and the receptacle contact can be mounted to an image pickup device unit and a circuit board, respectively, the image pickup device unit and the circuit board being electrically connected to each other by making an insertion of the plug into the insertion groove of the receptacle.

The connector can be incorporated in portable terminal equipment.

It is desirable for lengths of the two second projecting portions in the insertion/extraction direction of the plug to be the same.

It is desirable for the contact projecting portion to comes in sliding contact firstly with the first projecting portion and secondly with the second projecting portion when the plug is plugged into the insertion groove of the receptacle.

According to the present invention, foreign matter between the plug and the receptacle can be removed securely and easily because the wide first projecting portion is in sliding contact with the contact projecting portion in a wide range and further because at least one second projecting portion is in sliding contact with the contacting projecting portion while imposing a strong load on the contact projecting portion in a concentrated manner. Moreover, even if each plug contact and the associated receptacle contact are not precisely positioned relative to each other when the plug is plugged into the insertion groove of the receptacle, the contact resistance between the plug and the receptacle becomes stable because a portion of the contact projecting portion which is in sliding contact with the contacting portion when the plug is plugged into the insertion groove of the receptacle is formed as a flat surface. Furthermore, even if the plug is plugged and unplugged into and from the receptacle many times, there is little possibility of foreign matter accumulating between the receptacle and the plug, and accordingly, a stable contact resistance between the plug and the receptacle is achieved because no recess or gap is formed between the first projecting portion and the second projecting portion by the arrangement wherein one end the second projecting portion is formed integral with the first projecting portion.

BRIEF DESCRIPTION OF THE DRAWINGS

The present invention will be discussed below in detail with reference to the accompanying drawings, in which.

DESCRIPTION OF THE PREFERRED EMBODIMENTS

Figure 1:
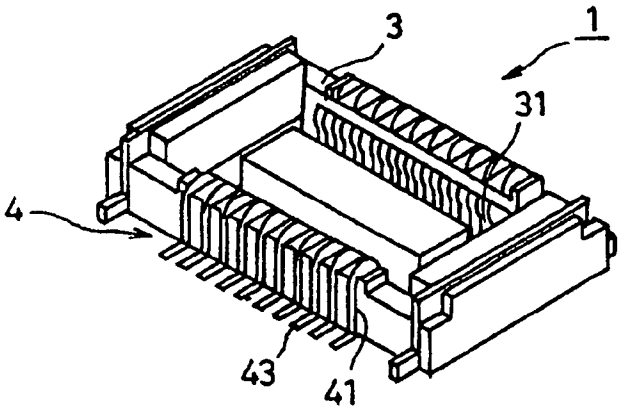
FIG. 1 is a perspective view of a receptacle which serves as an element of an embodiment of a connector according to the present invention, showing the overall structure of the receptacle.
Figure 4:
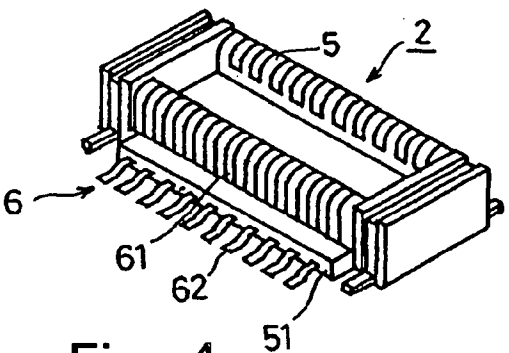
FIG. 4 is a perspective view of a plug which serves as an element of the embodiment of the connector according to the present invention, showing the overall structure of the plug.

An embodiment of a connector according to the present invention is provided with a receptacle 1 shown in FIG. 1 and an associated plug 2 shown in FIG. 4 which are engaged with each other to be electrically connected to each other. For instance, one of the receptacle 1 and the plug 2 is mounted to an LCD (liquid display device/display device) unit or a CCD (charge coupled device/image pickup device) unit, while the other of the receptacle 1 and the plug 2 is mounted to a board (e.g., circuit board) which is electrically connected to the LCD unit or the CCD unit to control operations thereof. The LCD unit or the CCD unit is electrically connected to the board by the engagement of the plug 2 with the receptacle 1. The receptacle 1 and the plug 2 can be adopted for establishing electrical connection within portable terminal equipment (e.g., a cellular phone, a PDA (personal digital assistant) such as a mobile computer and the like) or electrical connection between portable terminal equipment and external equipment. In addition to a LCD unit, the receptacle 1 and the plug 2 can be adopted for use in of the following display units: a CRT (cathode-ray tube) display unit, a plasma display unit and an organic EL (electroluminescent) display unit. Moreover, in addition to a CCD unit, the receptacle 1 and the plug 2 can be adopted for use in a CMOS (complementary metal oxide semiconductor) unit.

As shown in FIG. 1, the receptacle 1 is provided with a receptacle body 3 and a plurality of receptacle contacts 4, specifically two arrays of receptacle contacts 4. The receptacle body 3 is molded from an electrical-insulating synthetic resin by injection molding, and is provided with an insertion groove 31 into and from which the plug 2 is plugged and unplugged. The two arrays of receptacle contacts 4 are arranged on opposite sides of the insertion groove 31.

Figure 2:
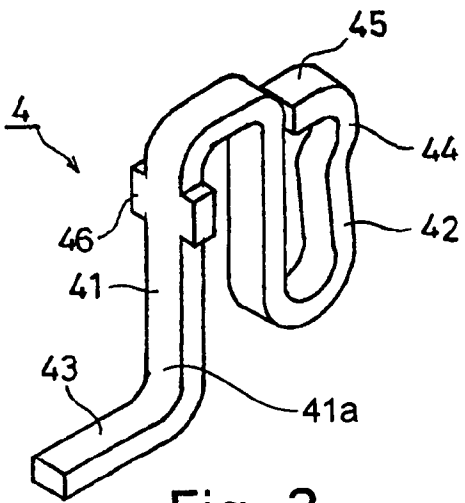
FIG. 2 is a perspective view of a receptacle contact of the receptacle shown in FIG. 1.

As shown in FIG. 2, each receptacle contact 4 is molded of metal by stamping so as to be formed in a strip shape, and is provided with a retaining portion 41, a resilient bendable portion 42 and a terminal portion 43 which are continuously formed as an integral member. The retaining portion 41 is formed in the shape of a letter U, and is held by the receptacle body 3 in a manner to pinch a side wall of an insertion groove 31. The bendable portion 42 together with the retaining portion 41, is formed in the shape of a letter S from one end of the bendable portion 42 which is positioned inside of the insertion groove 31, and is elongated into the insertion groove 31 from the retaining portion 41 to be resiliently bendable in a direction to change the distance between the bendable portion 42 and the retaining portion 41 (a direction that intersects the insertion/extraction direction of the plug 2 relative to the insertion groove 31). The terminal portion 43 is bent outwards by an angle of approximately 90 degrees relative to the retaining portion 41 to be elongated outwards from an outer end 41*a* of the retaining portion 41 which is positioned outside of the insertion groove 31 to a point some distance away from a bottom end of a side wall of the receptacle body 3 (i.e., an end of the side wall of the receptacle body 3 in a direction of insertion of the plug 2 into the insertion groove 31). The terminal portion 43 can be fixed to a conductive pattern formed on a circuit board by, e.g., soldering.

Each receptacle contact 4 is made of a base material (e.g., phosphor bronze, beryllium copper or titanium copper) on which firstly a base coating (e.g., nickel coating) is plated and subsequently a finishing coating (e.g., gold coating) is plated. In the case where each array of receptacle contacts 4 (each array of plug contacts 6 shown in FIG. 5) are arranged with a pitch of 0.3 mm through 0.5 mm, it is desirable that the thickness of each receptacle contact 4 be in the range of 0.05 mm through 0.15 mm from the viewpoint of spring design and workability in consideration of miniaturization of the connector and the reduction of the height thereof. In this particular case, it is desirable that the thickness of the base coating be in the range of 0.5 through 4.0 micrometers. This range is determined due to the fact that the effectiveness of the base coating becomes invalid if the thickness of the base coating is below 0.5 micrometers and that the base coating becomes cracked easily by a deformation thereof when the base coating is in sliding contact with the associated plug contact 6 of the plug 2.

The retaining portion 41 is provided with a locking piece 46 which is elongated in a widthwise direction of the receptacle contact 4 to make the receptacle contact 4 held securely by the receptacle body 3.

Figure 3:
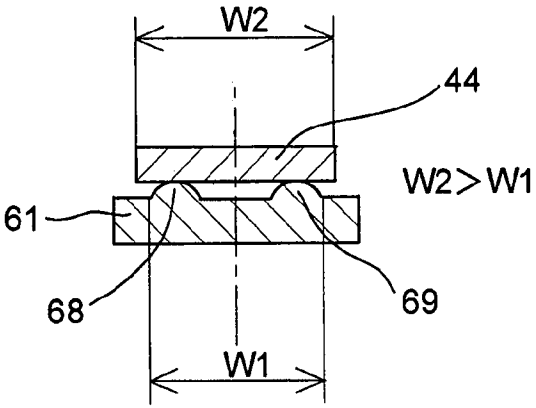
FIG. 3 is a cross sectional view of a receptacle contact of the receptacle shown in FIG. 1 and a contacting portion of an associated plug contact, showing the relationship between the width (W1) of two second projecting portions which project from the contacting portion of the plug contact and the width (W2) of a contact projecting portion of the receptacle contact.

The bendable portion 42 is provided with a contact projecting portion 44 which is formed by bending a portion of the bendable portion 42 to project in a direction away from the retaining portion 41. The contact projecting portion 44 resiliently projects in a direction that intersects the insertion/extraction direction of the plug 2 relative to the insertion groove 31 of the receptacle 1. Moreover, the contact projecting portion 44 is straight in the widthwise direction thereof, and is provided with a flat surface having a width W2 on a portion of the contact projecting portion 44 which comes in sliding contact with a contacting portion 61 of an associated plug contact 6 of the plug 2. The contacting portion 61 has two second projecting portions provided thereon which are arranged side by side in a direction that intersects the insertion/extraction direction of the plug 2 and extend parallel to each other in the insertion/extraction direction. As shown in FIG. 3, the width W2 of the flat surface of the contact projecting portion 44 is greater than a width W1 of the two second projecting portions 68 and 69 of the contacting portion 61 of an associated plug contact 6 (wherein the width W1 corresponds to the sum of the distance (spacing) between the two second projecting portions 68 and 69, the width of the second projecting portion 68 and the width of the second projecting portion 69). Accordingly, the contact projecting portion 44 can be precisely made efficiently because the contact projecting portion 44 is not formed to have a curved surface (the shape of which is difficult to be designed), especially when the thickness of the contact projecting portion 44 is small.

The bendable portion 42 is provided with an end portion 45 which projects from a free end (upper end as viewed in FIG. 2) of the contact projecting portion 44 toward the retaining portion 41 to lead the associated plug contact 6 into the insertion groove 31 and to prevent the bendable portion 42 from buckling when the plug 2 is plugged into the receptacle 1.

As shown in FIG. 4, the plug 2 is provided with a plug body 5 formed in the shape of a substantially rectangular parallelepiped, and a plurality of plug contacts 6, specifically, two arrays of plug contacts 6 which are arranged to correspond to the two arrays of receptacle contacts 4. The plug body 5 is molded of an electrical-insulating synthetic resin by insert molding, and each array of plug contacts 6 are arranged with the same pitch as the associated array of receptacle contacts 4.

Figure 5:
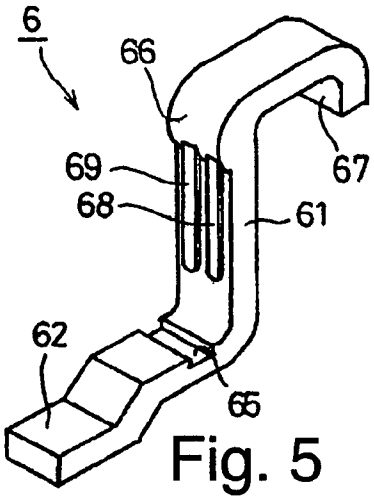
FIG. 5 is a perspective view of an embodiment of a plug contact of the plug shown in FIG. 4.
Figure 6:
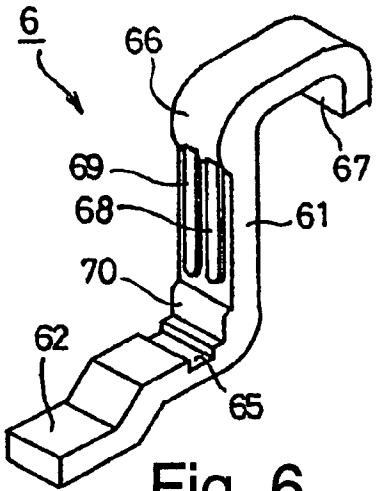
FIG. 6 is a perspective view of another embodiment of the plug contact of the plug.

As shown in FIG. 5, each plug contact 6 is molded of metal by stamping so as to be formed in a strip shape, and is provided with the contacting portion 61 and a terminal portion 62. The contacting portion 61 is held by the plug body 5 to extend in the insertion/extraction direction of the plug 2 relative to the insertion groove 31 of the receptacle 1 so that one of opposite surfaces of the plug contact 6 faces toward the outside of the plug body 5. The terminal portion 62 is bent outwards by an angle of approximately 90 degrees relative to the contacting portion 61 to be elongated in a direction away from the contacting portion 61. The terminal portion 62 can be fixed to a conductive pattern formed on a circuit board by, e.g., soldering. The terminal portion 62 is provided, on a portion thereof in the vicinity of the contacting portion 61, with a holding recess 65 at which the terminal portion 62 is smaller in thickness than the remaining part of the terminal portion 62. As shown in FIG. 6, it is possible that each plug contact 6 be further provided with a stepped portion 70, which is positioned between the holding recess 65 and the two second projecting portions 68 and 69, so as to bulge toward the contact projecting portion 44 of the associated receptacle contact 4.

Figure 7:
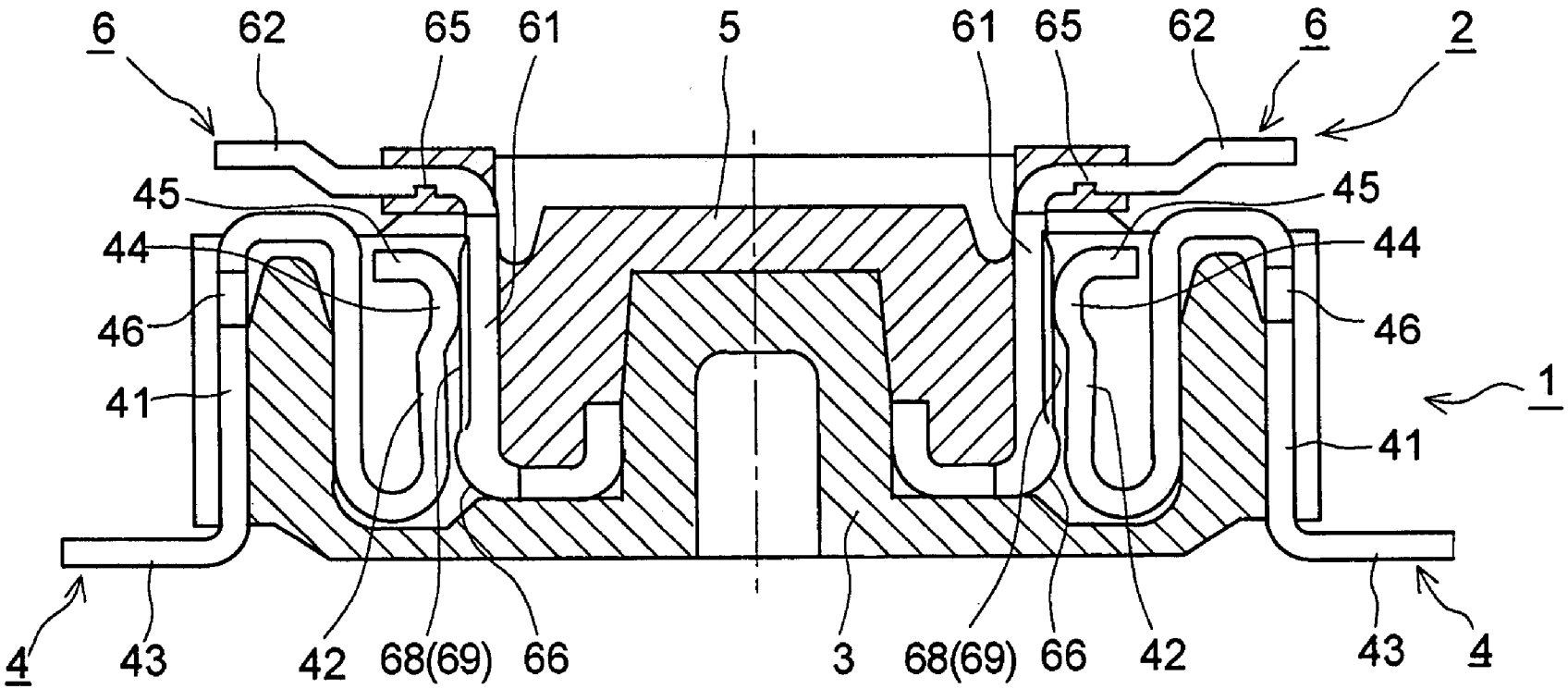
FIG. 7 is a cross sectional view of the receptacle shown in FIG. 1 and the plug shown in FIG. 4 which is plugged into the receptacle.

On the other hand, the plug body 5 is provided, on two opposed side walls thereof which are elongated in a lengthwise direction of the plug body 5, with two collar portions 51 which project in directions away from each other from bottom ends (lower ends as viewed in FIG. 4) of the two opposed side walls of the plug body 5, respectively. The terminal portion 62 of each lug contact 6 extends through the associated one of the two collar portions 51 as shown in FIGS. 4 and 7. The two arrays of plug contacts 6 are integrally molded as one piece with the plug body 5 via insert molding. After each plug contact 6 is attached to the plug body 5, melted synthetic resin serving as a material of each collar portion 51 is poured into the holding recess 65 of each plug contact 6, and is solidified to thereby prevent each plug contact 6 from coming off the plug body 5. In addition, each collar portion 51 protects the plug contact 6 from solder wicking; i.e., each collar portion 51 wards off solder wicking on the plug contact 6 when each terminal portion 62 of the plug contact 6 is soldered to, e.g., a conductive pattern on a circuit board.

Each plug contact 6 is made of a base material (e.g., phosphor bronze) on which firstly a base coating (e.g., nickel coating) is plated and subsequently a finishing coating (e.g., gold coating) is plated. In the case where each array of plug contacts 6 (each array of receptacle contacts 4 shown in FIG. 1) are arranged with a pitch of 0.3 mm through 0.5 mm, it is desirable that the thickness of each plug contact 6 be in the range of 0.05 mm through 0.15 mm from the viewpoint of spring design and manufacture, and in consideration of miniaturization and reduction of the height of the connector.

Each plug contact 6 is provided, on a surface of the contacting portion 61 thereof which comes in sliding contact with the contact projecting portion 44 of the associated receptacle contact 4, with a first projecting portion 66 which projects toward the contact projecting portion 44 of the associated receptacle contact 4, and the aforementioned two second projecting portions 68 and 69, each end (upper ends as viewed in FIG. 5) of which are formed integral with the first projecting portion 66 and are elongated in the insertion/extraction direction of the plug 2 relative to the insertion groove 31 of the receptacle 1. The two second projecting portions 68 and 69 project in a direction to come in contact with the contact projecting portion 44 of the associated receptacle contact 4 when the plug 2 is plugged and unplugged into and from the insertion groove 31 of the receptacle 1. A cross sectional shape of each second projecting portion 68 and 69 which is taken along a plane perpendicular to the insertion/extraction direction of the plug 2 relative to the receptacle 1 is semicircular in shape, the circular arc of which faces the contact projecting portion 44 of the associated receptacle contact 4 as shown in FIG. 3. The two second projecting portions 68 and 69 are substantially rectangularly shaped in a plan view, the opposed longer sides of which are parallel to each other. The two second projecting portions 68 and 69 are formed on the contacting portion 61 via a stamping die (not shown) having two grooves, the shapes of which correspond to the shapes of the two second projecting portions 68 and 69, by pressing the stamping die against a surface of the contacting portion 61 to crush a portion of the contacting portion 61 on which the two second projecting portions 68 and 69 are not formed. During this stamping process, depending upon the length of the stamping die, a lower portion of the contacting portion 61 in the vicinity of the holding recess 65 which is not crushed by the stamping die can be formed as the aforementioned stepped portion 70. Alternatively, the two second projecting portions 68 and 69 can be formed on the contacting portion 61 with a different stamping die (not shown) having two projections (the shapes of which correspond to the shapes of the two second projecting portions 68 and 69) by pressing the stamping die against a rear surface (opposite to the surface on which the two second projecting portions 68 and 69 are to be formed) of the contacting portion 61. Each plug contact 6 is further provided with an end portion 67 which extends from the first projecting portion 66 in a direction away from the contacting portion 61 (in a direction opposite to the direction of projection of the terminal portion 62) to lead the plug contact 6 into the insertion groove 31 and to prevent the contacting portion 61 from buckling when the plug 2 is plugged into the receptacle 1. The end portion 67, together with the holding recess 65, exhibits its function of holding the plug 2 in the insertion groove 31 of the receptacle 1.

In the case where each array of plug contacts 6 (each array of receptacle contacts 4 shown in FIG. 1) are arranged with a pitch of 0.3 mm through 0.5 mm, it is desirable that the height of each second projecting portion 68 and 69 be in the range of 0.01 mm through 0.10 mm. This range is determined because the efficiency of removing foreign matter by the two second projecting portions 68 and 69 decreases if the height of each second projecting portion 68 and 69 is smaller than 0.01 mm and because a material of the contacting portion 61 may not be stretched sufficiently to thereby cause the material to produce cracks or fractures in the case where the two second projecting portions 68 and 69 are made by pressing a stamping die against a rear surface of the contacting portion 61 if the height of each second projecting portion 68 and 69 is greater than 0.10 mm. From the viewpoint of the capability of removing foreign matter and manufacture, it is more desirable that the height of each second projecting portion 68 and 69 be in the range of 0.02 through 0.05 mm. To prevent each second projecting portion 68 and 69 from becoming cracked or fractured during the molding process, it is desirable that the two second projecting portions 68 and 69 be formed on the contacting portion 61 with a stamping die (not shown) having two grooves (the shapes of which correspond to the shapes of the two second projecting portions 68 and 69) by pressing the stamping die against a surface of the contacting portion 61 on which the two second projecting portions 68 and 69 are to be formed.

Although the number of second projecting portions formed on the contacting portion 61 can be one or more, it is desirable that two second projection portions be formed on the contacting portion 61, as in the case of the two second projecting portion 68 and 69, because the load imposed on each second projecting portion decreases if more than two second projecting portions are formed on the contacting portion 61. In the case of forming a plurality of second projecting portions on the contacting portion 61, it is desirable that the two second projecting portions be formed in a side by side configuration, elongated in a direction that intersects the insertion/extraction direction of the plug 2 relative to the receptacle 1 to enhance the efficiency of removing foreign matter. Moreover, in order to facilitate removal of foreign matter between the receptacle contacts 4 and the plug contacts 6, it is desirable that each second projecting portion be formed on the contacting portion 61 so as to be inclined with respect to the contact projecting portion 44 of the associated receptacle contact 4 to increase the distance between the second projecting portion and the contact projecting portion 44 in a direction from one end (upper end as viewed in FIG. 5) of the second projecting portion which is formed integral with the first projecting portion 66 to the other end (lower end as viewed in FIG. 5) of the second projecting portion when the plug 2 is plugged and unplugged into and from the receptacle 1. Furthermore, a cross sectional shape of each second projecting portion 68 and 69 which is taken along a plane perpendicular to the insertion/extraction direction of the plug 2 relative to the receptacle 1 can be not only a semicircular shape but also a substantially triangular shape or a half-oval shape having a predetermined radius of curvature which is curved toward the contact projecting portion 44 of the associated receptacle contact 4. The two second projecting portions 68 and 69 can be not only be substantially rectangularly shaped in a plan view, the opposed longer sides of which being parallel to each other, but alternatively can be substantially triangularly shaped in a plan view, wherein two non-parallel longer sides of each triangle approach each other.

According to the present embodiment of the contact having the above described structure, each of the first projecting portion 66 and the two second projecting portions 68 and 69 of each plug contact 6 comes into sliding contact with the contact projecting portion 44 of the associated receptacle contact 4 when the plug 2 is plugged and unplugged into and from the receptacle 1. Namely, foreign matter can be removed from between each receptacle contact 4 and the associated plug contact 6 in a wide range by the wide first projecting portion 66, and can be removed more reliably by the two second projecting portions 68 and 69 that come in sliding contact with the contact projecting portion 44 of the associated receptacle contact 4 while imposing a strong load thereon in a concentrated manner, especially when the plug 2 is plugged into the receptacle 1. Accordingly, the present embodiment of the contact is capable of removing foreign matter from between the plug and the receptacle reliably and easily.

In a state shown in FIG. 7 in which the plug 2 is properly plugged into the receptacle 1, the first projecting portion 66 of each plug contact 6 is disengaged from the resilient bendable portion 42 of the associated receptacle contact 4 as shown in FIG. 7 to allow the contact projecting portion 44 of each receptacle contact 4 to be in pressing contact with the two second projecting portions 68 and 69 of the associated plug contact 6. Namely, the first projecting portion 66 of each plug contact 6 does not come in contact with a surface of the resilient bendable portion 42 of the associated receptacle contact 4 on which the contact projecting portion 44 is not formed.

On the other hand, when the plug and the receptacle of the present embodiment of the contact are installed on a circuit board, foreign matter such as flux and the like may be scattered and deposited on the contacting portion 61. In this case, even if the plug 2 is plugged (engaged) into the receptacle 1, such foreign matter can be removed from the two second projecting portions 68 and 69 by repeatedly plugging and unplugging the plug 2 into and from the receptacle 1, which makes it possible to reliably remove such foreign matter, and accordingly, stabilize the contact resistance between the plug and the receptacle.

Since the contact projecting portion 44 of each receptacle contact 4, i.e., a flat surface thereof, is in sliding contact with the contacting portion 61 of the associated plug contact 6, the contact resistance between the plug and the receptacle maintains stable with little variation even if the plug contacts 6 and the receptacle contacts 4 are not precisely positioned relative to each other.

Even if the plug 2 is plugged and unplugged into and from the receptacle many times, there is little possibility of foreign matter accumulating between the receptacle 1 and the plug 2, and accordingly, a stable contact resistance between the plug and the receptacle is achieved because no recess or gap is formed between the first projecting portion 66 and each of the two second projecting portions 68 and 69 by the above described arrangement wherein one end (upper end as viewed in FIG. 5) of each second projecting portion 68 and 69 is formed integral with the first projecting portion 66.

A portion of the contact projecting portion 44 of each receptacle contact 4 which is in sliding contact with the contacting portion 61 of the associated plug contact 6 is formed as a flat surface, thus being capable of being made with a high degree of precision. On the other hand, even if each plug contact 6 is made thin, reliable contact of each receptacle contact 4 which comes in contact with the thin plug contact 6 are secured by the formation of the two second projecting portions 68 and 69 provided on the contacting portion 61 of the thin plug contact 6.

The functions of each receptacle contact 4 and each plug contact 6 are reversible. Namely, it is possible for a contact projecting portion, which corresponds to the contact projecting portion 44, to be formed on each plug contact and for a first projecting portion and two second projecting portions, which respectively correspond to the first projecting portion 66 and the two second projecting portions 68 and 69, to be formed on each receptacle contact.

Obvious changes may be made in the specific embodiments of the present invention described herein, such modifications being within the spirit and scope of the invention claimed. It is indicated that all matter contained herein is illustrative and does not limit the scope of the present invention.

What is claimed is:

1. A connector comprising:

a plug including a plug body made of an insulating material and at least one plug contact supported by said plug body;

a receptacle including a receptacle body made of an insulating material and at least one receptacle contact supported by said receptacle body, wherein said receptacle contact contacts said plug contact so as to be electrically connected with said plug contact when said plug is inserted into an insertion groove of said receptacle;

wherein said receptacle contact comprises a contact-projecting portion which is arranged to resiliently project towards said plug contact when said plug is inserted into or extracted from said insertion groove of said receptacle;

wherein said plug contact comprises a contacting portion to which said contact projecting portion contacts when said plug is inserted into or extracted from said insertion groove of said receptacle;

wherein said contacting portion comprises, a first projecting portion which is arranged to project towards said contact projecting portion, and two second projecting portions which are formed to be narrower in width than said first projecting portion and to extend in an insertion/extraction direction of said plug, each end of which is formed continuously with said first projecting portion, and each of said two second projecting portions projects towards said contact projecting portion; the first projection being greater in height than the second projections in a direction perpendicular to the insertion/extraction direction; and wherein a surface of said contact projecting portion, to which said contacting portion contacts, is formed to be flat in a cross-section of said contact projecting portion perpendicular to the insertion/extraction direction of said plug; and a width of said surface in a direction perpendicular to the insertion/extraction direction of said plug is wider than that of said second projecting portions.

2. The connector according to claim 1, wherein each of said second projecting portions is arranged to have a circular arch portion projecting towards said contact projecting portion, in a cross-section of said contacting portion which is perpendicular to the insertion/extraction direction of said plug.

3. The connector according to claim 1, wherein said second projecting portions are formed to increase a distance between said second projecting portions and contact projecting portion in a direction from said ends of said second projecting portions which are formed continuously with said first projecting portion to the other ends of said second projecting portions when said plug is inserted into or extracted from said insertion groove of said receptacle.

4. The connector according to claim 1, wherein one of said plug contact and said receptacle contact is mounted to a display device unit, and the other of said plug contact and said receptacle contact is mounted an a circuit board; and wherein said display device unit and said circuit board are electrically connected to each other by inserting said plug into said insertion groove of said receptacle.

5. The connector according to claim 1, wherein one of said plug contact and said receptacle contact is mounted to an image pickup device unit, and the other of said plug contact and said receptacle contact is mounted on a circuit board; and wherein said image pickup device unit and said circuit board are electrically connected to each other by inserting said plug into said insertion groove of said receptacle.

6. The connector according to claim 1, wherein said connector is incorporated in portable terminal equipment.

7. The connector according to claim 1, wherein said contact projecting portion comes in sliding contact firstly with said first projecting portion and secondly with said second projecting portions then said plug is inserted into said insertion groove of said receptacle.

8. The connector according to claim 1, wherein said second projecting portions are positioned side by side, with a predetermined distance therebetween, in the direction perpendicular to the insertion/extraction direction of said plug.

9. The connector according to claim 8, wherein lengths of said two second projecting portions in said insertion/extraction direction of said plug are the same.

10. The connector according to claim 8, wherein said second projecting portions are parallel to each other and extend along said insertion/extraction direction of said plug.

11. The connector according to claim 10, wherein lengths of said two second projecting portions in said insertion/extraction direction of said plug are the same.

* * * * *